US005316443A

United States Patent [19]

Smith

[11] Patent Number: 5,316,443

[45] Date of Patent: May 31, 1994

[54] REVERSIBLE MIXING IMPELLER

[75] Inventor: John M. Smith, Cranleigh, United Kingdom

[73] Assignee: Chemineer, Inc., Dayton, Ohio

[21] Appl. No.: 770,842

[22] Filed: Oct. 4, 1991

[51] Int. Cl.[5] ..... B01F 3/04

[52] U.S. Cl. ..... 416/197 R; 416/243; 366/270; 366/330

[58] Field of Search ..... 416/197 R, 197 A, 243, 416/DIG. 3; 366/270, 265, 330

[56] References Cited

U.S. PATENT DOCUMENTS

| | | | |
|---|---|---|---|
| 1,186,612 | 8/1916 | Taylor . | |
| 1,372,834 | 3/1921 | Schmelzer | 416/197 |
| 4,305,673 | 12/1981 | Herbst . | |
| 4,674,887 | 6/1987 | Lucke et al. . | |
| 5,198,156 | 3/1993 | Middleton | 416/197 |

FOREIGN PATENT DOCUMENTS

| | | | |
|---|---|---|---|
| 1078093 | 3/1960 | Fed. Rep. of Germany | 366/330 |
| 0016592 | of 1908 | United Kingdom | 416/243 |

*Primary Examiner*—Edward K. Look
*Assistant Examiner*—Mark Sgantzos
*Attorney, Agent, or Firm*—Biebel & French

[57] ABSTRACT

Liquid mixing impellers particularly designed for the chemical processing industry provide a generally axial flow when rotated in a first direction of rotation and provide a generally radial flow when rotated in the opposite direction of rotation. The blades are formed of sheet material with an edge which leads in the first direction of rotation being defined by a portion of the blade which is folded and turned in a chordwise sense through a limited extent back upon itself. The folded back leading edge forms a rearwardly facing concavity which faces the blade trailing edge. The power number in the radial flow rotation direction substantially exceeds the power number in the axial flow rotation direction.

9 Claims, 5 Drawing Sheets

REVERSIBLE MIXING IMPELLER

BACKGROUND OF THE INVENTION

This invention relates to a reversible mixing impeller, and more particularly to such an impeller which is designed to perform two different mixing functions, depending upon the direction of rotation.

The mixing processes, such as used in the chemical industry, often place conflicting demands upon the design of the mixing impeller. In the operation of a mechanically agitated batch reactor, an example of an agitation schedule might be described by the following typical steps:

a. The reactor or vessel is filled with a low viscosity liquid which is then heated to a reaction temperature.

b. Gas is introduced from a sparger. Mass transfer of the gas dispersed by the impeller is followed by a fast exothermic reaction in the liquid phase.

c. Temperature control is maintained by boiling off and refluxing some of the liquid while gas addition and dispersion by a mixer impeller continues.

d. The solid product of the reaction is precipitated and kept in suspension by the mixing impeller, while the particle size distribution is developed.

e. Suspension viscosity rises, and it becomes non-newtonian.

f. Finally, the reactor vessel is emptied. A relatively uniform concentration of the suspension is maintained as the level falls within the vessel.

At another time, the same reactor vessel or mixing tank may be used for a different product, thereby placing a different set of demands on the mixing impeller. Therefore, it is not surprising that the selection of an impeller for any given batch operation is frequently a matter of compromise. When considering a preferred design for any single stage of the program, as set forth in the above example, one might select a disc turbine impeller or a profiled impeller or one with a large swept volume. Obviously, one impeller alone is unlikely to meet optimally the particular mixing or blending requirements, since one impeller may have high efficiency for producing an axial flow, while another may have high efficiency in transferring energy from the impeller into a radial flow.

Traditional mixing impeller blades are symmetrical about some definable axis, and the power numbers of such impellers do not depend significantly on their direction of rotation. This implies that a fraction of the total kinetic energy of the outflow, associated with small scale turbulent fluctuations, is the same whichever way the impeller is rotated.

Complex impeller forms with specific advantages have also been developed. These designs have provided profiled, cambered hydrofoils with low drag coefficients, and produce large scale convective flows, usually axial, with a minimum of turbulence. Such modern agitator impellers are often asymmetric, designed to operate in a particular direction of rotation, and users must take care to ensure that they are mounted and operated properly.

It is believed that very little has been done to design an impeller which is reasonably efficient for the intended purpose, in either of two directions of rotation for the purpose of providing significantly different mixing effects with significantly different power numbers, depending on the direction of rotation. A single example is shown in U.S. Pat. No. 4,305,673 issued Dec. 15, 1991. In that impeller, primarily radial outflow is caused in either direction of rotation, the principal difference being that of the power number ratio between clockwise to counterclockwise rotations. Thus the impeller is described as simply drawing less power in one of two directions of rotation. Only one blade form is disclosed, Hurt lacks any concept of converting between primarily axial convective flow and primarily radial high turbulence and high shear flow when the rotation is reversed.

SUMMARY OF THE INVENTION

The invention is directed to an impeller which provides increased flexibility of process design and operation, and by a simple reversal of the direction of rotation, provides an alternative and radically different mixing objective. Two alternative operation modes are provided in an impeller which can, in one direction, generate a large flow volume of mainly axial flow, and in the opposite direction, generate a primarily radial turbulent flow.

The bulk convective flow, now a characteristic of high performance hydrofoil-type impellers, is often preferred for the functions of heat transfer, solid suspension uniformity, and mixing of high viscosity and/or non-Newtonian fluids. Pitched blade impellers which have a distributed turbulence and primarily axial bulk convection flow are used generally for blending, crystallization, leaching, liquid dispersion, and mass transfer in dispersions and suspensions.

On the other hand, certain processes require intense local turbulence of the kind developed by radial flow turbines and rotating serrated discs. These include micro-mixing, gas dispersion, and pigment deagglomeration. While specific impellers may be designed for each of these diverse purposes and thereby provide the highest efficiencies, the impeller designed in accordance with the teachings of this invention permits both of these divergent aims to be accomplished with only minimal loss in efficiency compared to specific or single purpose impellers, and, at the same time provides a savings in cost and in material where such versatility is desired.

An impeller designed according to this invention therefore can be used to produce local turbulence such as in a low viscosity medium to direct large scale motion of a viscous fluid. The impeller may be designed with either a downwardly directed or an upwardly directed pumping pattern in the axial flow mold (assuming a vertical shaft).

For the purpose of consistency, the terms "leading edge" and "trailing edge" as used herein are those terms associated with the rotation of the impeller in the axial bulk convection flow mode. The basic design includes generally radially extending blades with a major generally chordwise body portion which may or may not be formed with a curvature. The blades have at their leading edges a curved and folded back section of relatively short chordwise extent. Preferably, the curved back leading edge extends along the entire radial length of the blade. The elongated relatively flat body section defines a pitch angle with respect to the plane of rotation of the blade which may be either positive or negative, depending on whether the flow is respectively downward or upward, assuming a vertical drive shaft. The leading edge curved back portion may be positioned either on the top of the major body section or on its bottom, and at the suction side, as distinguished from the pressure side, of the blade.

A number of preferred cross-sectional profiles are disclosed herein, each of which is characterized by a principal or chordwise section of blade material having a generally uniform thickness, terminating at a trailing edge which is relatively streamline to the direction of flow thereover, having a forward or leading edge which is rolled or curved backward upon itself by from about 90° to 180°, terminated at a relatively short spanwise extent from the leading edge formed by the curve. In a sectional or end view, certain of the forms of the invention might be considered as resembling an airfoil, in which a portion of the suction or low pressure side has been removed to form a backward or trailing edge facing concavity or pocket.

The impeller blades may be constructed of plate type sheet material which is suitably bent to conform to the desired shape. Alternatively, a design of the blade in one embodiment may be fabricated as a closed ellipse in which half of the ellipse is removed, either figuratively or actually. The resulting blades, in axial performance, may be improved by modifying the inclined major surface, such as twisting the same or folding so as to change the apparent angle of attach from the root of the blade to the tip. Further, the blade may be tapered from root to tip, as is common with high efficiency impellers.

The impellers designed in accordance with this invention include a central hub which may be mounted for rotation about either a horizontal or vertical axis, or an inclined axis, as is well known in the mixing and agitating art, and for the purpose of description is shown as being mounted on a conventional vertical drive shaft and supporting a plurality of radially extending blades. The blades are preferably identical in construction and are characterized by a leading edge which is folded, bent, curved or otherwise brought back upon the major portion of the blade throughout a limited chordwise extent so as to form a concave pocket immediately behind the leading edge. The major portion of the blade body between the leading and trailing edge is formed with a pitch angle so that in one direction of rotation the impeller causes a primarily axial flow, and in the opposite direction of rotation the impeller causes a primarily radial flow.

The impeller blades are asymmetric about a plane perpendicular to a chordwise plane and may be made of sheet material having common and easy-to-form bends. They may be uniform throughout their radial extend which would permit blade sections to be severed from an extended length of blade material.

It is accordingly an important object of this invention to provide a mixer impeller which is capable of being run with efficiency in each of two directions of rotation and which provides primarily axial flow in one direction and radial flow in the other direction.

A further object of the invention is the provision of a mixing impeller in which there is a substantial and predictable difference in power number between each of two directions of rotation.

A still further object of the invention is to provide a mixing impeller which, in one direction of rotation, forms a pitch angle which effects a primarily axial flow of liquid, and which is formed with a concavity immediately behind the leading edge, the concavity having a chordwise extend forming a fraction of the total chordwise extend of the blade, so that when it is rotated in the opposite direction a primarily radial flow is caused.

A further object of the invention is the provision of an impeller for an agitator which is characterized by the ability to provide specifically different mixing effects, depending upon its direction of rotation. As an example, the impeller may be designed to produce a distributed turbulence with a comparatively large scale circulation in one direction of rotation, and to produce intense turbulence as a more moderate bulk circulation device in the opposite direction of rotation. These objects are accomplished in this invention with rigid blade impellers free of hinged, folding or moving sections.

Another object of the invention is the provision of an impeller having blades with leading edges which are swept over and back upon themselves so that when the rotation is reversed, the swept-back edge destroys the axial pumping action of the impeller and diverts the flow into an intensely turbulent and radial discharge.

These and other objects and advantages of the invention will be apparent from the following description, the accompanying drawings and the appended claims.

BRIEF DESCRIPTION OF ACCOMPANYING DRAWINGS

FIGS. 9A and 9B are diagrams showing the flow lines in which FIG. 9A represents typical flow lines in a direction of rotation effecting generally axially flow, while FIG. 9B represents flow lines in the opposite direction of rotation effecting radial flow.

DESCRIPTION OF PREFERRED EMBODIMENTS

Figure 1:
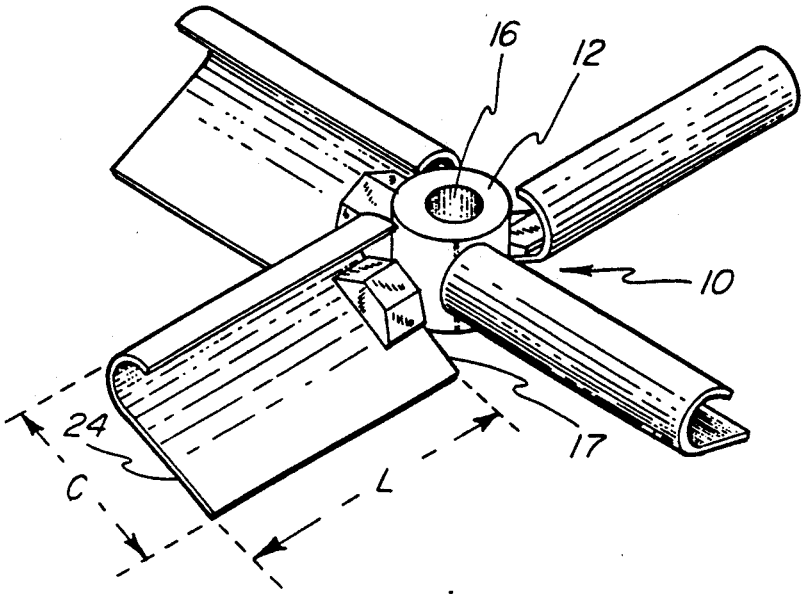
FIG. 1 is a perspective view of one embodiment of an impeller constructed according to this invention.

Referring to the figures of the drawings, which illustrate preferred embodiments of the invention, an impeller constructed according to this invention is illustrated generally at 10 in FIG. 1 as having a central hub 12 and a plurality of generally identical individual radially extending blades 15. The hub 12 has a conventional central opening 16 adapted to be mounted on the power or drive shaft of a mixer or impeller head. It is understood that a drive head for use with this invention is one which is adapted to be operated under load in either of two directions of rotation.

The blades 15 have root ends 17 mounted to the hub 12, such as by mounting tabs 18. The terminology of "leading" and "trailing" as used herein assumes a direction of rotation as to produce primarily axial flow, that is, a direction which is clockwise looking down on the impeller 10 as viewed in FIGS. 1 and 2. The blades 15 are preferably formed of sheet material, such as sheet metal, of uniform thickness, and define or form a leading edge 20 and a trailing edge 22. A major body portion 23 of the chordwise extent of the blade 15 between the leading and trailing edges is relatively flat in this embodiment. The blade 15 is retained by the mounting tabs 18 so that the flat portion 23 is inclined with respect to the axis of the hub 12 as viewed from the tip portion of the blade (FIG. 3) forms a pitch angle $\alpha$ to the plane 19 of rotation.

For the purpose of this description, the chordwise extent of the blade 15 from the root 17 to the tip 24 is represented by "C", and the blade length (FIG. 1) is represented by "L". The length L of the blade is preferably a multiple of the chord C such as L=approximately 0.5 to 10×C. The pitch angle $\alpha$, may be as low as 15° to 20° or may be as high as 45° or more. As previously noted, the blade 10 is straight, that is to say, it is not tapered, although it may be tapered within the scope of the invention.

The leading edge 20 of the blade 15 is curved or folded backwardly upon itself at least through a curvature of 90° and not much in excess of 180°, and terminates at an edge 30 spaced from the blade body section 23 to form a concave rearwardly-facing or trailing pocket 32. The pocket 32 faces the trailing edge 22 and extends radially the length L of the blade 15, while the spanwise extent of the reverse curved leading edge portion to the edge 30 forms a small portion of the total chord C of the blade. Thus configured, the blade 15 may be considered as having a pressure side which is the under side of blade portion 23 in FIG. 3, remote from the pocket 32 and a suction side which includes the pocket 32 and the edge 30.

Figure 2:
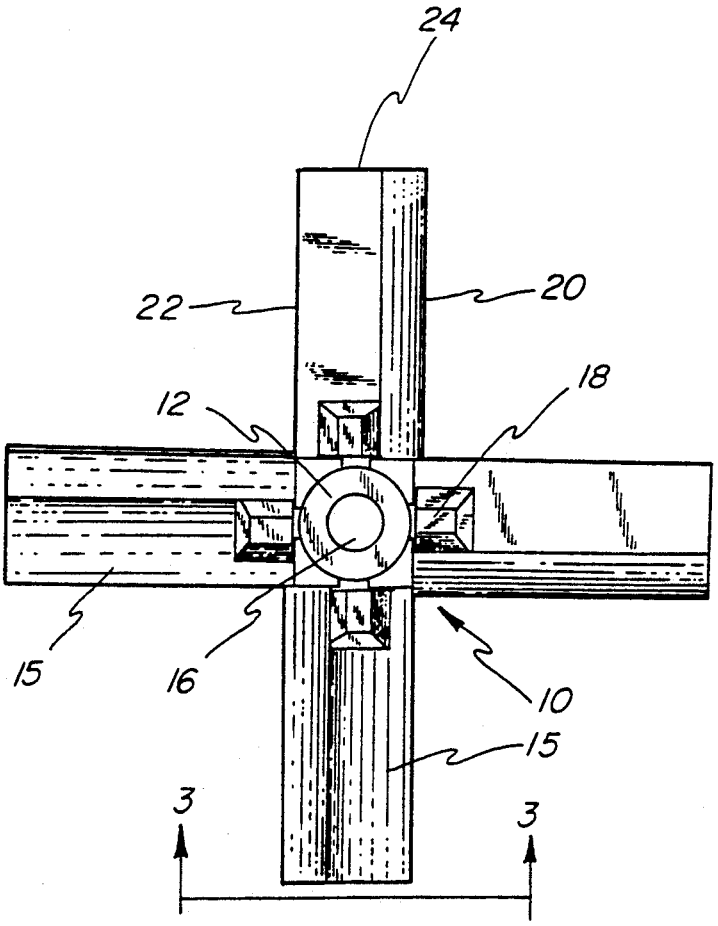
FIG. 2 is a plan view looking down on the impeller of FIG. 1.

The blade form which is presented provides an approximate airfoil configuration when the blade is driven in the direction as to produce a primarily axial flow, clockwise as viewed in FIGS. 1 and 2. When the direction of rotation is reversed, the upper edge 30 and the pocket 32 destroy the axial pumping action, and diverts the flow into an intensely turbulent, generally radial discharge.

Figure 9B:
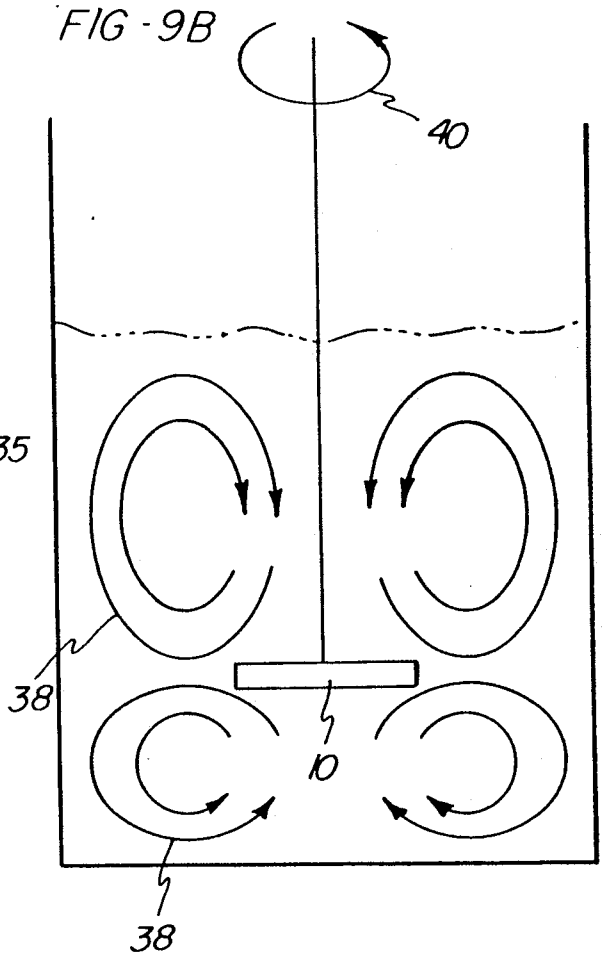
Figure 9A:
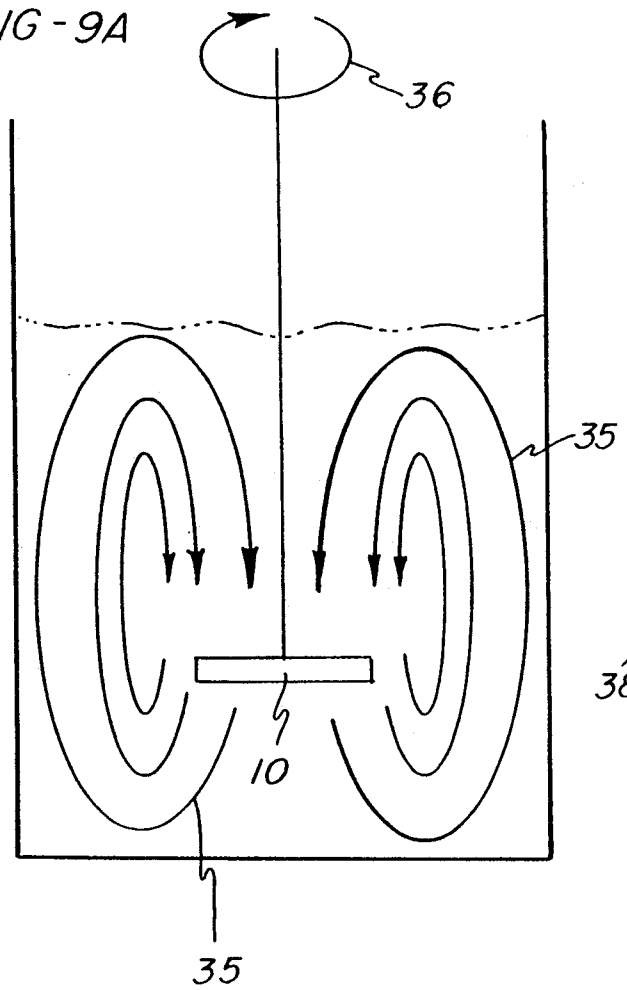

The flow lines 35 as shown in FIGS. 9A represent the generally axial flow lines when the impeller 10, as described, is driven in the clockwise direction as represented by the arrow 36. Conversely, the flow lines 38 shown in FIG. 9B are representative of the generally radial flow which occurs when the direction of rotation of the impeller 10 is reversed, that is counterclockwise, as represented by the arrow 40.

In further defining the blade shape, the blade may be considered as having an aspect ratio in the general range of between about 2 to 1 to about 8 to 1, the aspect ratio being defined as the ratio of the blade chord C to the perpendicular height of the opening 32; in other words, the ratio of maximum blade chord to maximum blade thickness. The trailing edge 22 is generally streamline to the flow over the blade in the axial mode. The edges 30 and 22 may be chamfered as is known in the art.

It is within the scope of the invention to have a radially tapered blade form, although preferably, the blade leading and trailing edges are parallel to each other and the blades are formed from relatively straight extending sections of blade material. This simplifies blade construction, permits the manufacture of blade material of an indefinite or extended length, from which the blades may be cut.

Figure 3:
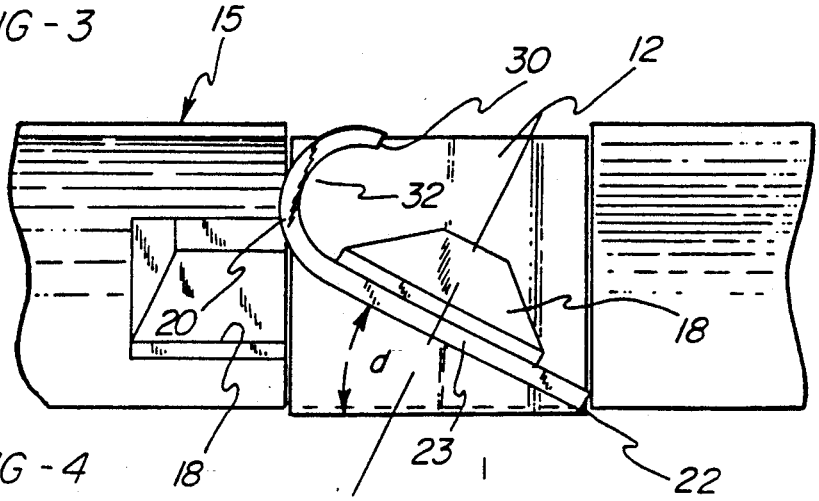
FIG. 3 is an enlarged and fragmentary side view of the impeller of FIGS. 1 and 2 looking generally along the view line 3—3 of FIG. 2.
Figure 4:
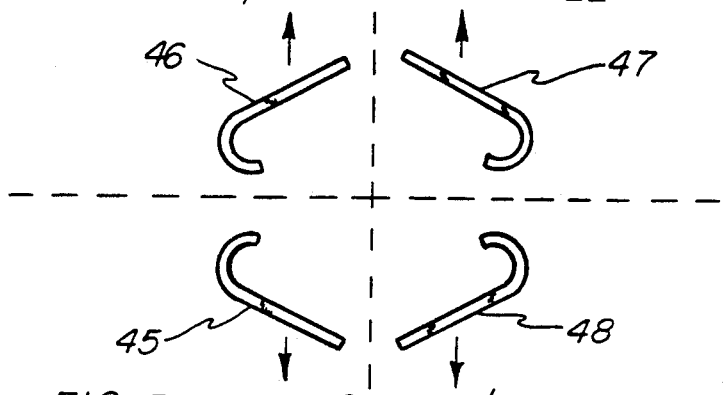
FIG. 4 is a diagram showing four modes of operation of an impeller in accordance with this invention.

FIG. 4 diagrammatically represents four conditions of operation of an impeller 10, and illustrates effectively mirror images of the blade positions, as viewed from an end. Thus, the position illustrated at 45 is that of the blade of FIG. 3 and provides a downward flow when rotated in the clockwise direction. Inverting the impeller results in a mirror image position 46 immediately above position 45 which provides a generally axially upward flow when rotated in the clockwise direction. Providing mirror images as shown at 47 and 48 respectively provides axial upward flow and axial downward flow when the same impeller is operated in the counterclockwise direction.

Figure 8:
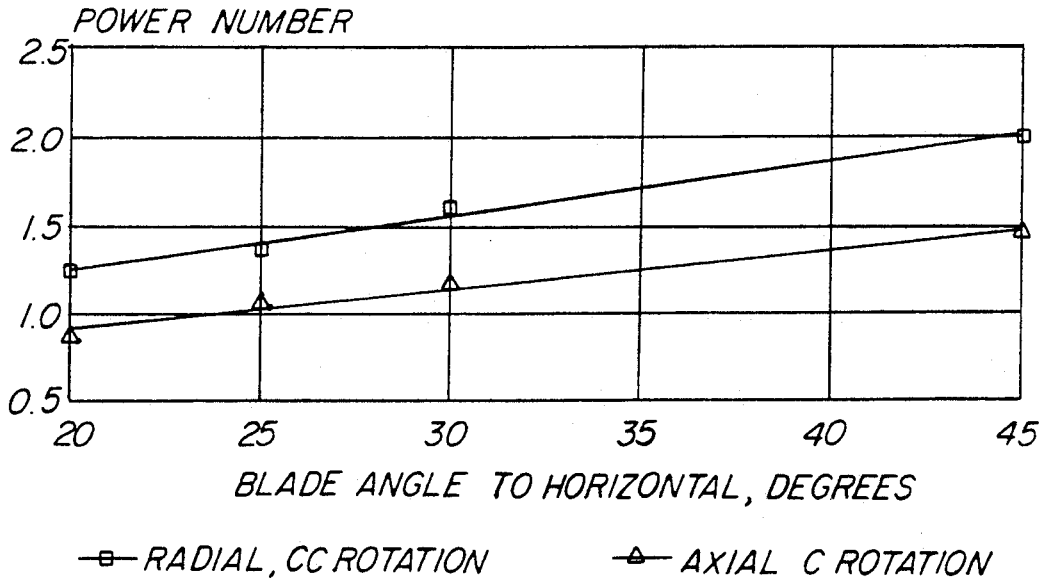
FIG. 8 is a graph showing the relationship between power number and blade angle of blades constructed according to this invention.

FIG. 8 represents the different power numbers of a blade constructed according to the teachings of FIGS. 1-3 when rotated to provide axial flow by clockwise rotation, and then when rotated to provide radial flow by counterclockwise direction. This diagram illustrates power numbers which were obtained by setting the blades at blade angles $\alpha$ of 20°, 25°, 30°, and 45°. It will be noted that these points fall generally along straight lines, and the actual power numbers are lower in the axial flow mode and are higher in the radial flow mode.

It will be understood that the power number is a dimensionless number commonly used to define mixing impeller efficiencies, and is a ratio of the power input P divided by fluid density $\pi$ times the speed of rotation N cubed times blade diameter D to the fifth power, and expressed as follows:

$$N_p = \frac{P}{\rho N^3 D^5}$$

The ratio of the radial to axial power numbers vs. blade angle falls along a relatively straight line between 1.3 and 1.4, and is generally unaffected by actual blade angle, although the actual power number increases linearly with increase in blade angle. It will be understood that the power number diagrams represented by FIG. 8 are for turbulent flow conditions.

Figure 5:
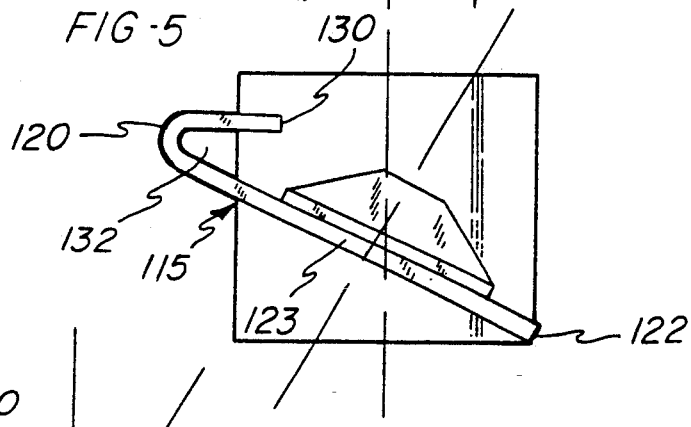
FIG. 5 is an end view of another preferred form of the impeller blade.

In the embodiment of FIG. 3, the curvature of the leading edge 20 which defines the radial trailing concavity 32 is generally semi-cylindrical when viewed in section. Such a curvature may be formed in a simple bending or forming operation. However, it is within the scope of the invention to provide different blade forms, such as illustrated by the blade forms shown in FIGS. 5-7 where like parts are illustrated by like reference numerals plus 100 for FIG. 5, plus 200 for FIGS. 6 and 6A, and plus 300 for FIG. 7. In FIG. 5, the leading edge 120 is formed by bending a portion of the material forming the blade 115 back upon itself through a small radius bend, thereby forming, in end view, a generally wedge-shaped cavity 132. In many instances, such a bending operation may be preferred and will provide comparable mixing results.

Figure 6:
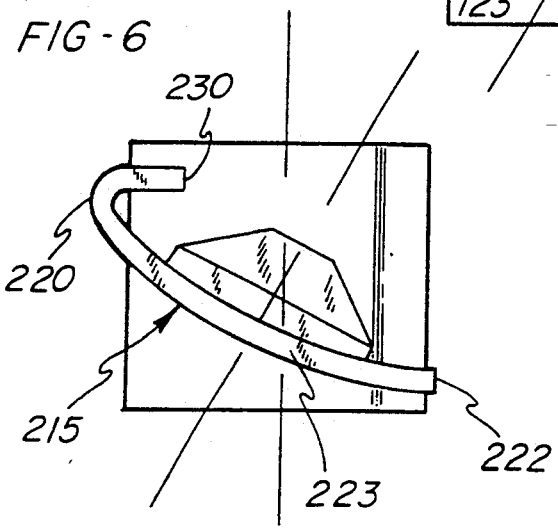
FIG. 6 is an end view of a third preferred form of the impeller blade.
Figure 6A:
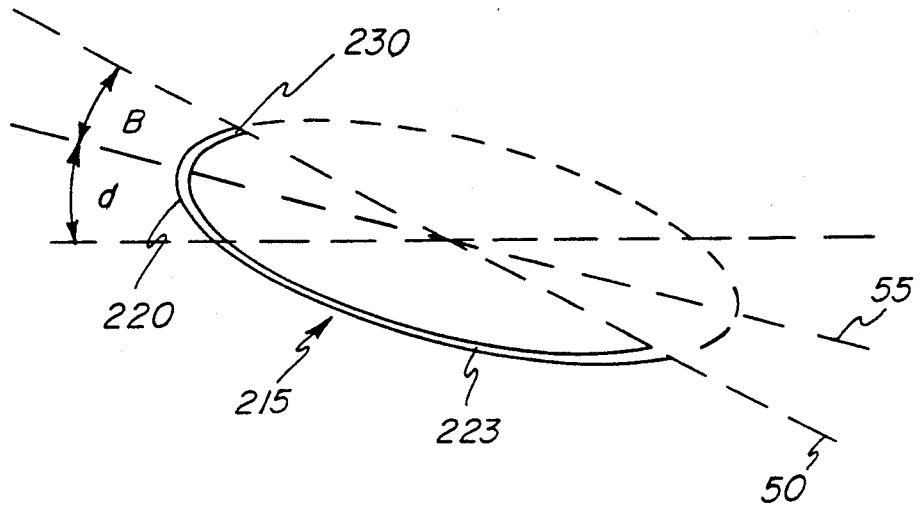
FIG. 6A is a diagram showing the mode of generation of the blade form of FIG. 6.

FIGS. 6 and 6A illustrate a particularly useful form of the blade 215 in which the blade section illustrated is actually one-half of an ellipse, as shown in FIG. 6A. A tube may be constructed or configured in the form an ellipse, the ellipse having a relatively high aspect ratio from about 4 to 1 up to about 6 to 1 or more, although it is within the scope of the invention to form ellipses with higher or lower aspect ratios. A cut line 50 is formed through the ellipse at an angle $\beta$ to the major axis 55 of the ellipse. In this manner, two blades may be formed from a single section of elliptical tubing. The angle $\beta$, for example, may be about 30° and the angle $\alpha$ may be defined as the angle of the major ellipse axis 55 to the horizontal plane of rotation. Since the major body portion 123 is curved, it has a high beam strength compared to the flat section 23 of FIG. 3.

Figure 7A:
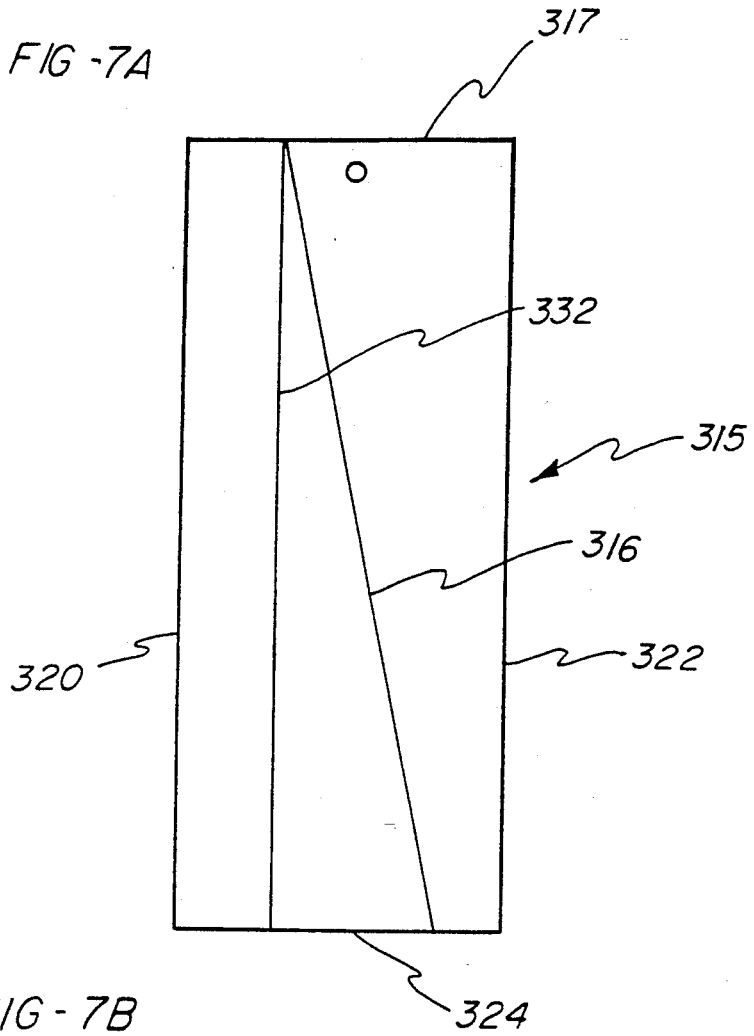
FIG. 7A is a plan view of a fourth preferred form of a blade in accordance with this invention.
Figure 7B:
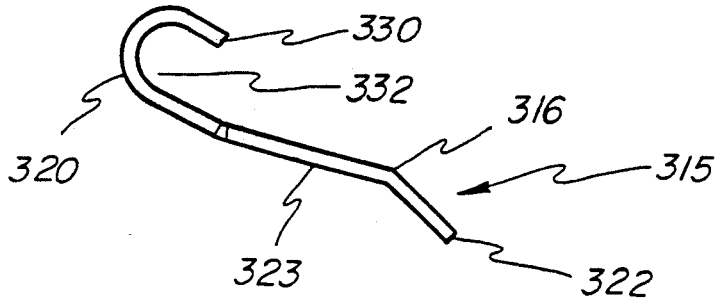
FIG. 7B is an end view of the blade of FIG. 7A.

In the embodiment shown in FIGS. 7A and 7B, a sheet metal blade 315 is formed with a generally radial but diagonally extending bend line 316 through the body section 223 from a point near the leading edge at the root end 317 to a point near the trailing edge at the blade tip 324. The diagonal bend line 316 defines or forms a camber inducing bend which extends spanwise of the blade to form a blade forward portion which is bent or turned downwardly about the bend line, such as through an angle of about 20°, from the rearward portion. Such a blade in which the camber is defined by a diagonal bend line, is similar in concept to a high efficiency impeller known as the HE-3 which is marketed by Chemineer, Inc., the assignee of this application.

The forward portion of the body 223, in the embodiment of FIGS. 7A and 7B, defines a leading edge 320 which is curved or folded backward upon itself substantially the same as previously described in connection with the embodiment of FIGS. 1–4, to define a concave rearwardly facing or trailing pocket 332. The pocket 332 faces the trailing edge 322, as in the preceding embodiments, and extends radially the length of the blade 315. The spanwise extent of the reverse curved leading edge portion 330 forms a small portion of the total chord of the blade. The configuration of the invention as illustrated in FIGS. 7A and 7B, under tests, have demonstrated an increased power number ratio when rotated in the reverse direction, that is the direction associated with the flow lines of FIG. 9B.

The principles of operation of impeller blades and impellers constructed according to this invention are believed to be obvious in view of the foregoing description and well within the ability of selection by persons who are skilled in the mixing art. In a typical utilization, such as in a polymerization reactor, an initial intense mixing stage may be followed by the need for good macroscopic blending, as the fluid viscosity rises. Thus, at the start of the reaction, the impeller is operated in the radial flow mode in which the trailing edge 22 becomes the leading edge. Fluid flows into the concavity 32, and is directed generally radially outwardly. The concavity 32 defined by the nose curvature and edge 30 effectively destroys the axial pumping action which would otherwise be obtained by a flat blade operating in that direction. The pumping flow lines are shown in FIG. 9B.

A generally axially flow which is generated when the impeller is driven in the opposite direction is more effective at maintaining a good bulk motion, as illustrated in FIG. 9A, as the viscosity arises. The axial flow circulation pattern and its turbulence level will be determined by the blade profile and the angle $\alpha$. The axial pumping characteristics can be improved by modifying the angle of the inclined surface, or modifying the surface itself such as illustrated in FIG. 7. The individual blades themselves can be twisted to vary the blade angle from a maximum at the hub to a minimum at the tip so that the blade angle corresponds more accurately to the actual angle of attack, as well understood in the art.

It is understood that the axial pumping mode of the various embodiments of the impellers of this invention will produce a somewhat divergent outflow due to the fact that a vortex will be formed at the blade edge 30 which will cause some of the material being moved to roll into the cavity 32 and then radially along the cavity outwardly to the blade tip, thereby producing a minor radial outflow component. This is not necessarily detrimental to the primarily axial flow component of the impeller and may be particularly effective for solid suspensions.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A liquid mixing impeller operable by changing the direction of rotation to produce distinctively differing mixing modes, comprising:

said impeller having a hub for mounting on a driven shaft, a plurality of substantially identical blades each extending generally radially from said hub, said blades each having a root portion attached to said hub and each having axially remote blade tips, each of said blades being formed of sheet material having generally radially extending chordwise spaced edges extending from said root portion to said tip, the same one of said blade edges on each of said blades being defined by a blade portion folded and turned back upon itself through a limited chordwise extent to form a concavity which faces the other blade edge, the remainder of each of said blades being relatively flat and being inclined with respect to the axis of said hub when viewed from said blade tips to define a positive pitch angle with respect to the plane of rotation of said blades thereby defining for each of said blades a pressure side on one side of said blade and a suction side on the opposite side of said blade such that said concavities are positioned on said blade suction sides when said impeller is rotated in the direction wherein said folded edge portions are the leading edges, and said impeller generates an axial flow and whereby said impeller is rotated in the opposite direction said concavities cause said blades to develop a radially outward flow.

2. The mixing impeller of claim 1 in which said concavities are generally semi-cylindrical when viewed from said blade tips.

3. The mixing impeller of claim 1 in which said blade concavities are semi-elliptical when view from said blade tips.

4. The mixing impeller of claim 1 in which said blade concavities are generally wedge-shaped when viewed from said blade tips.

5. The mixing impeller of claim 1 in which the chordwise extent of said turned back blade portions define a blade thickness and in which the chordwise length of said blades, thereby defining an aspect ratio to said thickness between 2:1 to 4:1.

6. The impeller of claim 1 in which each said blade is formed as half of an ellipse which has been cut at an angle of about 30° to the major axis of the ellipse.

7. The impeller of claim 1 which has a ratio between the power number in said opposite direction of rotation to the power number in said first named direction of rotation of between about 1.3 to 1 to about 1.4 to 1.

8. In a liquid mixing impeller including a hub mounted on a shaft and operated in either of two directions of rotation, and a plurality of blades extending generally radially of said hub, the improvement comprising:

each of said blades defining a leading edge and a trailing edge in one said direction of rotation and a body portion extending chordwise between said leading and trailing edges to form a positive pitch angle with respect to a common plane of rotation of said blades, said blades at adjacent said leading edges each having a chordwise length of material which forms a curved blade portion which extends toward said trailing edge and terminates at a chordwise position which position is a fraction of the chordwise extent of said blade body portion, said curved blade portion defining with said body portion a generally concave radially extending pocket immediately behind said leading edge and facing said trailing edge and defining in said one direction of rotation a blade suction side including said pocket, and a blade pressure side opposite said suction side, whereby when said impeller is rotated in said one direction it generates an axial flow and when said impeller is rotated in the opposite direct said pockets cause said blades to develop a radially outward flow.

9. A liquid mixing impeller according to claim 8 in which said chordwise lengths of material extend spanwise the radial extent of said blades.

* * * * *